United States Patent [19]

Mohn et al.

[11] 4,155,862

[45] May 22, 1979

[54] LIQUID DEVELOPER FOR COLOR ELECTROPHOTOGRAPHY AND PROCESS FOR PREPARATION OF THE SAME

[75] Inventors: Eugen Mohn, Bubikon; Hansjürg Hermann, Egg, both of Switzerland

[73] Assignee: Konishiroku Photo Ind. Co., Ltd., Tokyo, Japan

[21] Appl. No.: 698,389

[22] Filed: Jun. 21, 1976

[30] Foreign Application Priority Data

Jun. 25, 1975 [DE] Fed. Rep. of Germany ..... 2528339

[51] Int. Cl.[2] ..... G03G 9/12

[52] U.S. Cl. ..... 252/62.1 L; 96/1 LY; 96/1.2

[58] Field of Search ..... 252/62.1 L, 62.1 P, 252/62.1 R; 96/1 LY, 1.2

[56] References Cited

U.S. PATENT DOCUMENTS

| | | | |
|---|---|---|---|
| 3,253,913 | 5/1966 | Smith et al. | 252/62.1 L |
| 3,259,581 | 7/1966 | Matkan | 252/62.1 L |
| 3,852,208 | 12/1974 | Nagashima et al. | 252/62.1 |
| 3,901,696 | 8/1975 | Mohn et al. | 96/1 PE |
| 3,971,659 | 7/1976 | Sato et al. | 252/62.1 L |
| 3,976,583 | 8/1976 | Herrmann et al. | 252/62.1 L |
| 3,980,577 | 9/1976 | Hotta | 252/62.1 L |

*Primary Examiner*—George F. Lesmes
*Assistant Examiner*—Bruce H. Hess
*Attorney, Agent, or Firm*—Arnstein, Gluck, Weitzenfeld & Minow

[57] ABSTRACT

Liquid developer formulations adapted to colored toners suitable for trichromatic processes in electrophotography, the toners being lightfast organic dye pigments with substantially no photoconductivity which are mixed with a paraffinic material as a protective polymer (a dispersing liquid being used if the protective polymer is a solid) and suspended in an insulating hydrocarbon carrier medium together with a metal soap and a phenol derivative soluble in the carrier.

5 Claims, No Drawings

LIQUID DEVELOPER FOR COLOR ELECTROPHOTOGRAPHY AND PROCESS FOR PREPARATION OF THE SAME

BACKGROUND OF THE INVENTION

1. Field of the Invention

The present invention refers to a liquid developer for color electrophotography and to a process for its preparation.

2. Description of the Prior Art

Production of colored or multi-colored images by electrophotographic processes can be accomplished, for example, as disclosed in U.S. Pat. No. 3,901,696, of which we are the inventors and which is assigned to the same assignee. According to this patent, an image is obtained by exposing a photoconducting layer to an original, thus producing on or in this layer a conductivity pattern corresponding to the original. The pattern is used to control a field produced by means of two electrodes, the field being in the space between the photoconducting layer and a support for the image to be produced. Electrically-charged toner particles in the above-mentioned space are moved through this field, the toner particles having their origin in a liquid developer introduced into the space between the photoconducting layer and the image support prior to establishing the field. The polarity of the toner particles and the polarity of the electrode assigned to the photoconducting layer are either selected opposite to one another so that the toner particles deposit on the photoconducting layer, or these polarities are selected to be identical so that the toner particles deposit on the support. The electrical field is subsequently interrupted, as a result of which in the first case toner particles migrate from the photoconducting layer to the support and produce on the latter a positive image corresponding to the original whereas in the second case, toner particles migrate from the support to the photoconducting layer and thus leave behind on the support a negative image corresponding to the original.

The present invention thus concerns a liquid developer for color electrophotography, particularly the process (hereinafter referred to as the "conductivity modulation process") of the above-cited U.S. patent, and while it is possible, of course, to produce color images electrophotographically according to the mentioned process using already known developers, the images produced in that manner still leave much to be desired with respect to contrast, sharpness, resolution and color saturation. Furthermore, in the production of multicolored images by superposition of several partial color images, certain difficulties have been encountered, for example, when conventional "self-fixing" agents in known developers deposit together with color pigments of a partial image and modify the surface of the support bearing the partial image. The modification occurs in such manner that it significantly disturbs the subsequent step for formation of a next partial color image, with resultant inability to produce high quality copies of the original.

The above-mentioned difficulty cannot be eliminated simply by omission of the fixer in the developer since other essential properties of the developer are than impaired unacceptably. Another requirement with respect to the dye pigments of such developers lies in the fact that the images produced therewith must be permanent, and light- and solvent resistant. Further, in known developers the color pigments are customarily embedded in a resin shell. Such a dye pigment resin mass must be pulverized to a fineness not possible by mechanical means as regards the pigments used in the developer disclosed here.

Since no optimal developer is yet known for the above-mentioned process for electrophotographic image production, the basic task of the present invention is to create a liquid developer for production of colored or multicolored images by means of electrophotography; a developer which does not exhibit the named disadvantages and is particularly characterized by the fact that it results in high contrast, sharp color images exhibiting a high image resolution and a high color saturation, one which ensures the unobjectionable superposition of individual partial color images in the production of multicolored copies. The task also comprises creation of a process for production of the named liquid developer.

SUMMARY OF THE INVENTION

The present invention concerns a liquid developer for color electrophotography having an organic liquid as dispersion medium for at least one lightfast organic dye pigment without pronounced photoconductive properties and at least one protective polymer, comprising a waxy aliphatic hydrocarbon as the protective polymer in combination with at least one metal soap for charge control of the dispersion and at least one oxidation protective agent for age stabilizing the liquid developer.

The invention also concerns a process for preparation of the named liquid developer.

DESCRIPTION OF THE PREFERRED EMBODIMENTS

In the following description, the invention is illustrated in more detail.

Liquid developers according to the present invention are characterized in the ready-to-use state by the following data;

viscosity 1–10 cP (centipoises)
specific resistance $10^9$ to $10^{12}$ ohm cm
specific charge 200–2000 $\mu$C/g (microcoulomb/gram)
pigment particle size 0.1–5 $\mu$m (microns)

Since a liquid developer of the named type should be ready to use for an extended time, e.g., four weeks, it is important that changes in its properties, such as irreversible agglomeration of the dye particles, should not occur within this time span. Also, with respect to image resolution and desired color saturation, it is important to select an advantageous size distribution of the particles used as dye pigment. For the color developer according to the invention, only those substances are suitable which, after a partial color image has been deposited, have not modified the image support surface such that further production of partial images is made difficult or impossible. The liquid developer according to the invention further ensures complete depositing of the dye pigment material present during the particular image formation step at the illuminated points, the charge remaining behind on the deposited partial color images being so trivial in each case that transport of already-precipitated pigment particles by electrical fields is no longer possible in subsequent image production steps.

Although the liquid developer according to the invention contains none of the fixer customary in known developers, the partial color images produced with the developer according to the invention have proven to be sufficiently sturdy to withstand successive operations in the image production process such as squeezing out superfluous dispersion, receiving a further partial color image, laminating a protective layer on the finished copy etc., without undergoing damage.

A liquid developer according to the present invention consists of the following components:

1. Dispersion medium: Organic, highly insulating liquid of low polarity with the following properties:

specific resistance at least $10^{12}$ ohm cm dielectric constant (maximum) 4 boiling point between 130° and 180° C.

As particular examples of materials that are effective, one can list: ISOPAR E, G, and H (these being trademarks for long chain saturated hydrocarbons differing in vapor pressure, boiling point and viscosity which are commercially available from Esso), SHELLSOL (trademark for a similar hydrocarbon supplied by Shell), kerosene, polysiloxanes, and fluorohydrocarbons.

2. Organic dye pigment: Lightfast materials of low density which correspond as exactly as possible to one of the ideal substractive basic colors (yellow, purple, blue-green) for the production of color images.

particle diameter 0.1–5 $\mu$m (microns)

density (maximum 2 g/cm$^3$

Pigment materials may have no pronounced photoconductive properties. Here, exemplary materials for utilization include the following:

Yellow: Diazo dyes, preferably of the benzidine series. OPPASIN yellow 141, TM (BASF, Ludwigshafen, West Germany) HELIO fast yellow GRN, TM (Bayer, Leverkusen, West Germany) (Color Index I: Pigment Yellow 13/Color Index II: No. 21,100)

Purple: Dye lacquers of acidic or basic xanthene dyes. FANALROSA SM 4830 TM (BASF, Ludwigshafen, West Germany) (Color Index I: Pigment Red 81/Color Index II: No. 45,160).

Blue-green: Modified Phthalocyanines which are nonphotoconducting or only slightly photoconducting. HELIO fast blue GO, TM (Bayer, Leverkusen, West Germany) (Color Index I: Pigment Blue 15/Color Index II: No. 74,160).

3. Charge control agent: Metal soaps with a multivalent cation and fatty acid radicals with 8 to 14 carbon atoms. Dissociation constant K of approximately $10^{-5}$. As materials which have proven suitable, one can mention metal soaps such as Co-decanoate, Zr-decanoate, and Ca-decanoate (all three being available commercially from SCADO of Zwolle, Netherlands).

4. Protective polymer: High molecular weight waxy aliphatic hydrocarbons (hereinafter referred to generally as "paraffins") particularly of the branched type, with $10^3 < M < 10^6$ (M being the molecular weight). The protective polymer serves for adjustment of optimal viscosity in the mechanical pulverization (elevation of the shear forces and thus the milling effiiciency) as well as for increasing stability of the finished liquid developer. The paraffin is fully soluble in the dispersion medium, does not form a coating on the particles, and has no essential fixing action. Furthermore, it causes little, if any, interference with the action of the above-mentioned charge control agent. Though other paraffins have been used successfully here, a material proven particularly suitable is polyisobutylene, a branched type paraffin available commercially under the trademark OPPANOL B3 from BASF, Ludwigshafen, West Germany.

5. Oxidation protective agent: Materials such as hydrocarbon-soluble phenol derivatives, which hinder a rapid aging of the liquid developer by oxidative processes, particularly at higher temperatures. Examples of the best such phenol derivatives are 2,6-di-tertiary butyl-4-methylphenol (available commercially from Shell under the trademark IONOL CP) and 1,3,5-trimethyl-2,4,6-tris-(3,5-di-tertiary butyl-4-hydroxybenzyl)-benzene (available commercially from Shell under the trademark IONOX 330).

The liquid developer is preferably prepared as follows: A viscous mixture of dye pigment and protective polymer is prepared by grinding the ingredients at least twice in mult-roll mill, such as a three-roll mill, to obtain the desired size range of the pigment particles. Conveniently, a dispersion medium may also be added in case the protective polymer is a solid. The mass obtained in this manner is then diluted with dispersion medium while adding charge control agent and oxidation protective agent up to the point where the dye pigment content amounts to 10 percent by weight. For attainment of good, complete mixing, this dilution may conveniently be accomplished with continuous agitation in a high frequency disperser. In this resultant concentrated form, the liquid developer can be stored over an extended time without deterioration. For preparation of the liquid developer ready for use, a certain amount of the concentrate is diluted further to a desired pigment concentration, described subsequently, again under constant stirring.

A detailed formula now follows for a liquid developer having the color yellow, one for the color purple, and lastly one for the color blue-green:

EXAMPLE 1 — Yellow Liquid developer:

250 g. yellow pigment (Helio fast yellow GRN, Bayer) is ground together two times with 750 g. OPPANOL B3 (BASF) on a three-roll mill to produce 1000 g. of a 25% paste. 100 g. of this 25% paste is agitated well with 25 g. zirconium decanoate (Scado, 12% metal content), 5 g. IONOL CP (Shell) diluted to 250 g. with ISOPAR G (Esso), and agitated for 10 minutes with a high frequency agitator. 50 g. of this 10% concentrate is diluted with the ISOPAR G to 1000 g. and shaken well. In this manner, "ready-to-use" liquid developer results which contains 0.5% pigment, 1.5% OPPANOL B3 (BASF), 0.5% zirconium decanoate (Scado) and 0.1% IONOL CP (Shell).

EXAMPLE 2 — Purple Liquid developer:

All operations and weight statements are the same as in the foregoing first example with the exceptions: instead of yellow pigment, a purple pigment (FANALROSA SM 4830, BASF) is used and cobalt decanoate (Scado, 8% metal content) is used instead of zirconium decanoate. The concentrations of the ingredients of the finished purple liquid developer ready for use thus amount to 0.5% pigment, 1.5% OPPANOL B3 (BASF), 0.5% cobalt decanoate (Scado), and 0.1% IONOL CP (Shell).

EXAMPLE 3 — Blue-green Liquid developer:

All operations and weight statements are the same as in the first example with the following exceptions: blue-green (cyan) pigment (Helio fast blue GO, Bayer) is used instead of yellow pigment and 5 g. zirconium decanoate (Scado) is used instead of 25 g. zirconium decanoate. The concentrations of the ingredients of the finished, "ready-to-use" blue-green liquid developer thus amount to 0.5% pigment, 1.5% OPPANOL B3 (BASF), 0.1% zirconium decanoate (SCADO), and 0.1% IONOL CP (Shell).

The above three liquid developers, when used in an apparatus according to the previously-cited U.S. patent, gave rise to the very best copies, these having high contrast, sharp color images with high resolution and color saturation. Nearly equal results were obtained with the other materials listed when incorporated in liquid developers of the type disclosed and used in the above-mentioned apparatus. Further, while the specific examples given recite particular concentrations, these are merely the values for the very best results with the materials of these examples; there being a range of values in which the results are substantially identical. As to the remaining materials, in some cases the range depends on the particular ones of the materials which are combined. Thus, it has been found experimentally with the materials disclosed herein that copies of excellent quality can be obtained with finished liquid developers where concentration of the individual components range in amount (weight percent except as indicated):

Pigment 0.1 to 5%, preferably 0.3 to 0.8%

Charge control agent $10^{-4}$ to $10^{-1}$ molar, preferably $10^{-3}$ - $10^{-2}$ molar Protective polymer 0.1 to 10%

Oxidation protective agent 0.001 to 1%, preferably 0.1%.

While particular embodiments of the invention have been shown and described, modifications will be evident to those skilled in the art, and it is intended in the claims to cover all such modifications which fall within the spirit and scope of the invention.

We claim:

1. A liquid developer for color electrophotography comprising an organic highly insulating liquid of low polarity as dispersion medium for from about 0.1 to about 5% by weight of at least one lightfast, organic dye pigment of low density and from about 0.1 to about 10% by weight of polyisobutylene having a molecular weight of greater than 1,000 and less than 1,000,000 as at least one protective polymer, at least one metal soap containing a multivalent cation and a fatty acid radical with 8 to 14 carbon atoms contained therein in from about $10^{-4}$ to about $10^{-1}$ molar quantity for charge control of the dispersion, and from about 0.001 to about 1% of at least one hydrocarbon-soluble phenol derivative selected from the group consisting of 2,6-di-tertiary butyl-4-methylphenol and 1,3,5-trimethyl-2,4,6-tris-(3,5-di-tertiary butyl-4-hydroxybenzyl)-benzene as an oxidation protective agent for age stabilizing the liquid developer.

2. A liquid developer for color electrophotography comprising an organic highly insulating liquid of low polarity as dispersion medium for from about 0.1 to about 5% by weight of at least one lightfast, organic dye pigment of low density and from about 0.1 to about 10% by weight of at least one waxy aliphatic hydrocarbon having a molecular weight of greater than 1,000 and less than 1,000,000 as at least one protective polymer, at least one metal soap containing a multivalent cation and a fatty acid radical with 8 to 14 carbon atoms contained therein in from about $10^{-4}$ to about $10^{-1}$ molar quantity for charge control of the dispersion, and from about 0.001 to about 1% of 2,6-ditertiary butyl-4-methylphenol as an oxidation protective agent for age stabilizing the liquid developer.

3. A liquid developer for color electrophotography comprising an organic highly insulating liquid of low polarity as dispersion medium for from about 0.1 to about 5% by weight of at least one lightfast, organic dye pigment of low density and from about 0.1 to about 10% by weight of at least one waxy aliphatic hydrocarbon having a molecular weight of greater than 1,000 and less than 1,000,000 as at least one protective polymer, at least one metal soap containing a multivalent cation and a fatty acid radical with 8 to 14 carbon atoms contained therein in from about $10^{-4}$ to about $10^{-1}$ molar quantity for charge control of the dispersion, and from about 0.001 to about 1% of 1,3,5-trimethyl-2,4,6-tris-(3,5-di-tertiary butyl-4-hydroxybenzyl)-benzene as an oxidation protective agent for age stabilizing the liquid developer.

4. A liquid developer for color electrophotography comprising an organic highly insulating liquid of low polarity as disperson medium for from about 0.1 to about 5% by weight of at least one lightfast, organic dye pigment of low density and from about 0.1 to about 10% by weight of polyisobutylene having a molecular weight of greater than 1,000 and less than 1,000,000 as a protective polymer, at least one metal soap containing a multivalent cation and a fatty acid radical with 8 to 14 carbon atoms contained therein in from about $10^{-4}$ to about $10^{-1}$ molar quantity for charge control of the dispersion, and from about 0.001 to about 1% of at least one hydrocarbon-soluble phenol derivative as an oxidation protective agent for age stabilizing the liquid developer.

5. Process for preparation of a liquid developer comprising the steps of:

(1) producing a viscous mixture of at least one lightfast, organic dye pigment of low density and polyisobutylene having a molecular weight of greater than 1,000 and less than 1,000,000 as protective polymer by (2) grinding said mixture a plurality of times in a multi-roll mill, (3) a. diluting the viscous mixture obtained in step 2, with an organic highly insulating liquid of low polarity while agitating, and b. adding in the course of the dilution at least one metal soap containing a multivalent cation and a fatty acid radical with 8 to 14 carbon atoms as a charge control agent and at least one hydrocarbon-soluble phenol derivative selected from the group consisting of 2,6-ditertiary butyl-4-methyl-phenol and 1,3,5-trimethyl-2,4,6-tris-(3,5-tertiary butyl-4-hydroxybenzyl)-benzene as an oxidation protective agent for age stabilizing the liquid developer, (4) ceasing the dilution when the dye pigment content makes up 10% of the solution, thereby forming a liquid concentrate storable at the specified pigment content, and (5) diluting the storable concentrate further with an organic highly insulating liquid of low polarity in a final process step to obtain a concentration of dye pigment of from about 0.1 to 5% by weight, of polyisobutylene as protective polymer of from about 0.1 to about 10% by weight, of said at least one hydrocarbon-soluble phenol derivative as an oxidation protective agent of from about 0.001 to about 1% by weight, and the metal soap as charge control agent in from about $10^{-4}$ to about $10^{-1}$ molar quantity, so as to make the developer ready for use.

* * * * *